US006741218B2

(12) United States Patent
Cavelier et al.

(10) Patent No.: US 6,741,218 B2
(45) Date of Patent: May 25, 2004

(54) MULTIBEAM ANTENNA SYSTEM

(75) Inventors: Luc Cavelier, Cannes (FR); Thierry Judasz, Ramonville (FR); Jean-Marc Bassaler, Toulouse (FR)

(73) Assignee: Alcatel, Paris (FR)

( * ) Notice: Subject to any disclaimer, the term of this patent is extended or adjusted under 35 U.S.C. 154(b) by 15 days.

(21) Appl. No.: 10/208,862

(22) Filed: Aug. 1, 2002

(65) Prior Publication Data

US 2003/0025643 A1 Feb. 6, 2003

(30) Foreign Application Priority Data

Aug. 2, 2001 (EP) ..... 01402094

(51) Int. Cl.[7] ..... H01Q 13/00
(52) U.S. Cl. ..... 343/779; 343/840; 343/781 P
(58) Field of Search ..... 343/779, 775, 343/840, 781 P, 781 LA, 834, 835

(56) References Cited

U.S. PATENT DOCUMENTS 4,482,897 A 11/1984 Dragone et al. ..... 343/779
4,855,751 A 8/1989 Ingerson ..... 343/779
5,136,294 A * 8/1992 Iwata ..... 343/781 P
6,211,842 B1 4/2001 Cousin et al. ..... 343/840

FOREIGN PATENT DOCUMENTS

EP 0 670 609 A1 9/1995 ..... H01Q/19/17

OTHER PUBLICATIONS

Uneko K: "Properties of a large scale multibeam antenna using a phase array fed reflector with radially aligned elements" IEEE Antennas and Propagation Society International Symposium. 1999 Digest. APS Orlando, Florida, Jul. 11–16, 1999, New York, NY: IEEE U.S., vol. 14, Jul. 11, 1999, pp. 2298–2301

* cited by examiner

*Primary Examiner*—Hoang V. Nguyen
(74) *Attorney, Agent, or Firm*—Sughrue Mion, PLLC

(57) ABSTRACT

A multi-beam antenna system including a parabolic reflector with a parallelogram perimeter, which is illuminated by a plurality of feed elements. The parabolic reflector reflects a first beam corresponding to one frequency that illuminates a first parallelogram spot, and a second beam corresponding to the same frequency illuminates a second parallelogram spot. The first and second spots are parallelepiped and are arranged such that spots of the same frequency are generally not adjacent to each other.

8 Claims, 5 Drawing Sheets

MULTIBEAM ANTENNA SYSTEM

FIELD OF THE INVENTION

The present invention relates to a multibeam antenna system for focusing and concentrating incident electromagnetic waves at a preselected direction that impinges a predetermined coverage area on the earth.

More specifically, to an antenna system for producing communication beams, which have improved isolation characteristics around the spots at a prescribed coverage zone, covered by the antenna. This type of geometry is implemented when the purpose is to reuse the same frequency multiple times over a given coverage area.

BACKGROUND OF THE INVENTION

A multibeam antenna system for producing spots on the ground comprises reflector means that has a circular shape and a plurality of feed elements. The plurality of the feed elements is usually arranged in a hexagonal arrangement. So, the parabolic reflector cooperates with the plurality of the feed elements to transmit and/or receive electromagnetic waves.

Therefore, the antenna system illuminates a group of spots with a circular cross-section, shown in FIG. 1, by use of a group of feeds arranged in a hexagonal array feeds.

In addition, the plurality of the beams is generated simultaneously by the provision of different frequencies of electromagnetic radiation in each of the beams. The mechanical accommodation of feeds a to produce adjacent spots requires usually 3, 4 or more antenna. Each feed provides a spot at the coverage area and there are several spots of the same frequency.

Unfortunately, the radiating diagram of the spots produced through a circular reflector is isotropic, shown in FIG. 2. Due to that fact side lobes of each beam radiate into the spots provide by other feeds of the same frequency, namely it causes interference between signals of the same frequency. So, these side lobes reduce the carrier over interference ratio C/I, which is one of the main parameter to assess efficiency at a transmission.

This interference is undesirable because it reduces the overall efficiency of the system to transmit information. An isolation among spots of the same frequency of greater than 15 dB would be highly desirable.

In view of the foregoing, there is a need for a multibeam parabolic antenna system that improves isolation among beams of the same frequency, resulting in a more efficient satellite communication system.

SUMMARY OF THE INVENTION

The technical problems mentioned above are resolved by the invention by constituting a multi-beam antenna system including a parabolic reflector with a parallelogram perimeter, which is illuminated by a plurality of feed elements; so that the parabolic reflector reflects a first beam corresponding to one frequency that illuminates a first elliptical spot, a second beam corresponding to the some frequency that illuminates a second elliptical spot, such that the first and second spots are generally un-adjacent.

Any number of spots may be defined by projecting additional beams from the multi-beam antenna.

The antenna system provides for improved uniformity of signal gain with a simplified mechanical structure of the antenna system.

The present invention therefore introduces a spot-clustering scheme wherein spots are elliptical arranged one un-adjacent another of the same frequency.

One of the main advantages of the spot-clustering scheme of the present invention is that, side lobes corresponding to one beam of one predetermined frequency are out of main lobe of the another beam of the same frequency. Therefore, the isolation among beam of the same frequency is improved.

BRIEF DESCRIPTION OF THE DRAWINGS

A more detailed explanation of the invention is given in the following description based on the attached drawings in which.

DESCRIPTION OF THE INVENTION

In general an antenna produces a beam of predetermined intensity over a designated geographic area, also called coverage.

The multi-beam antenna system of the present invention is used for communications between a satellite and the earth, for example. The multi-beam antenna system is adapted to transmit a group of beams as required for specific applications.

Figure 4:
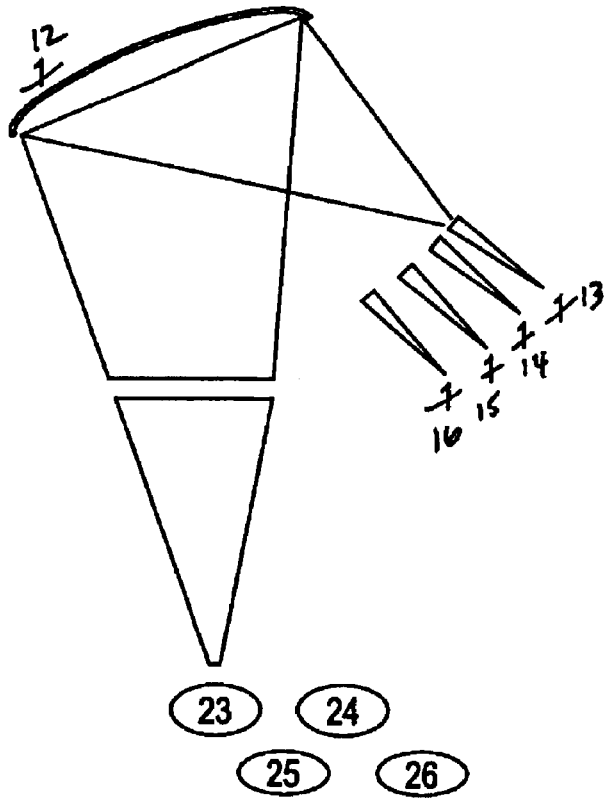
FIG. 4 is a diagrammatic representation in plan view of a radiation diagram of the rectangular antenna in accordance with the present invention.

Referring initially to FIG. 4, a multi-beam antenna embodying of the present invention is shown. In this embodiment, the multi-beam antenna system includes a reflector means 12 that is illuminated by a plurality of the feeds 13, 14, 15 and 16 with an offset geometry.

The reflector means has a surface of parabolic shape, formed of a material that reflects RF. The rectangular reflector 12 forms an antenna beam in a preselected direction that impinges a predetermined coverage area on the Earth.

In another embodiment of the invention the single parabolic reflector is illuminated by feeds 13–16 disposed substantially at its focus (not shown).

Mechanical means (not shown) are provided to hold the feeds 13 at the focus of the reflector 12 in a fixed and optimal geometrical arrangement.

Depending on the position of the reflector 12, the beams illuminate different places on the Earth. The beams illuminate the spots 23, 24, 25 and 26 and generally designated by the reference numeral 23. The reflector 12 reflects incident RF energy propagating and forms an ellipse lying on ground, shown in FIG. 5

Figure 1:
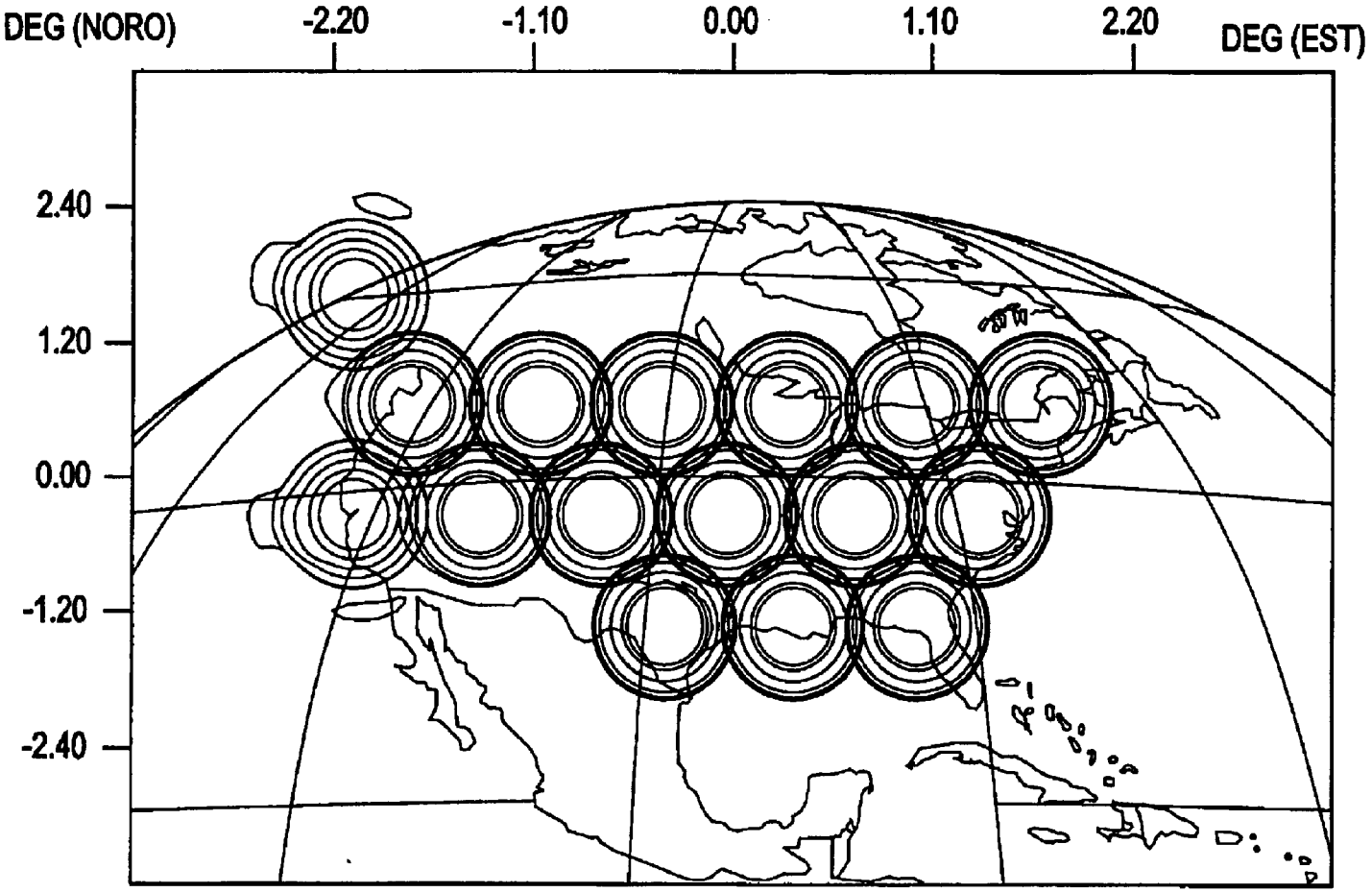
FIG. 1 is a plot of typical spot beams formed on the surface of the earth by a circular parabolic antenna illuminated by a set of feeds.
Figure 2:
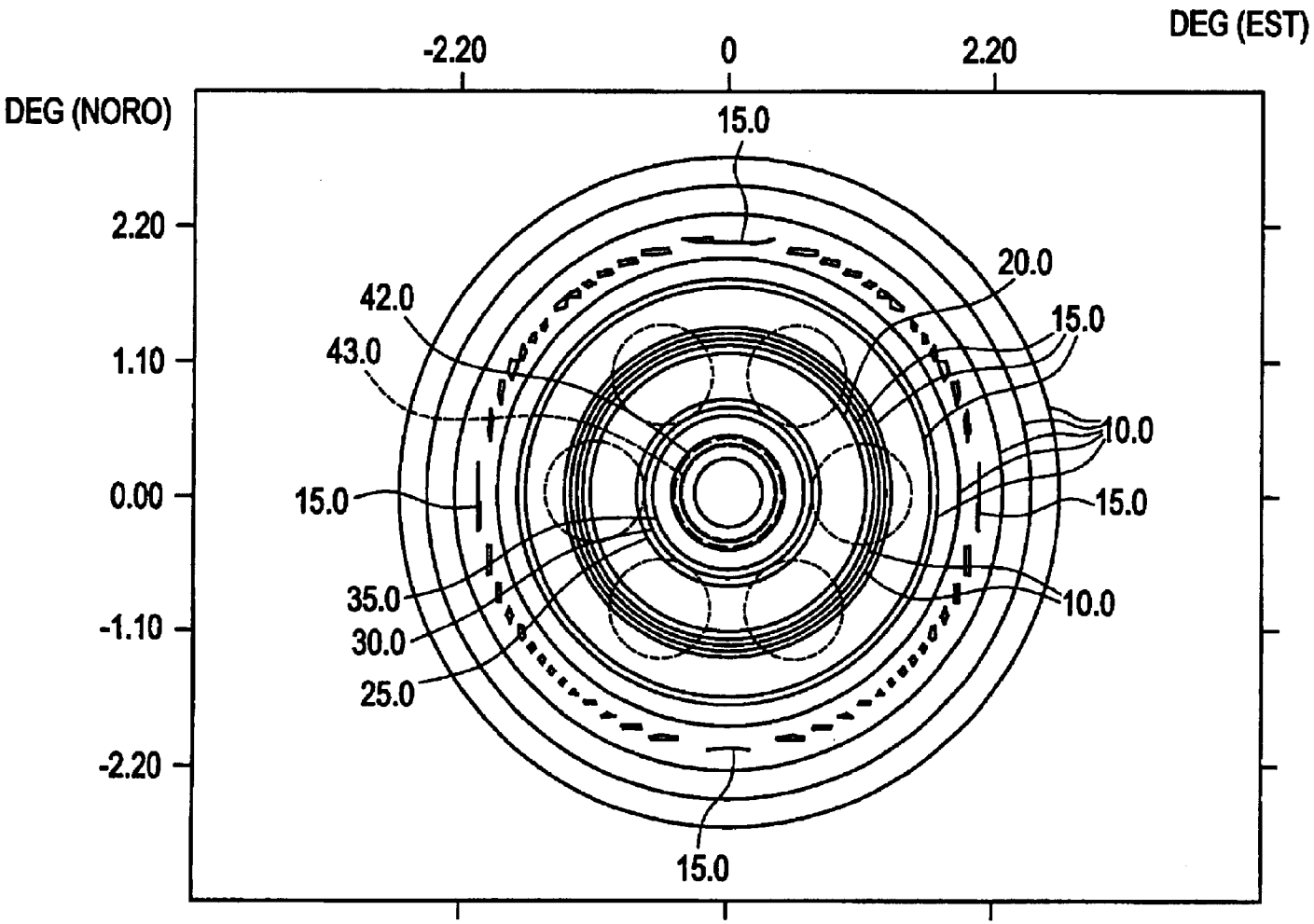
FIG. 2 is a plot of typical radiation diagram of one beam produced by one circular parabolic antenna.
Figure 3:
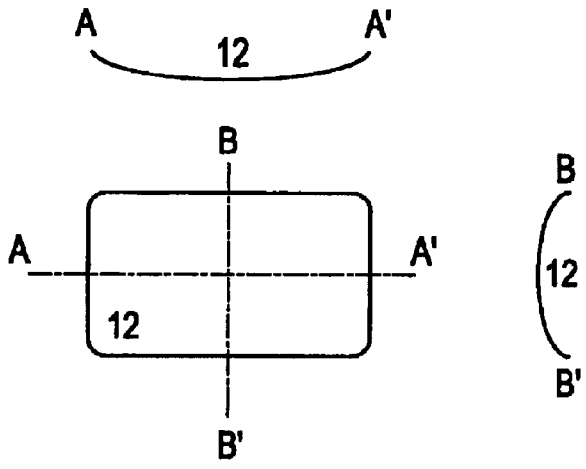
FIG. 3 shows in cross-section on the line AA', in plan view and in cross-section on the line BB' one embodiment of a rectangular parabolic reflector for an antenna system in accordance with the present invention.

Turning now to FIG. 3, the reflector 12 based on a parabolic reflector surface has a parallelogram perimeter, namely, rectangular rim when is projected onto the x-y plane, lines AA' and BB', respectively.

It is noted that the shape of the reflector 12 as seen in plan view in FIG. 3 is virtually rectangular. The cross-sections on AA', BB' in FIG. 3 respectively, are parabolic arcs of different length.

Figure 5:
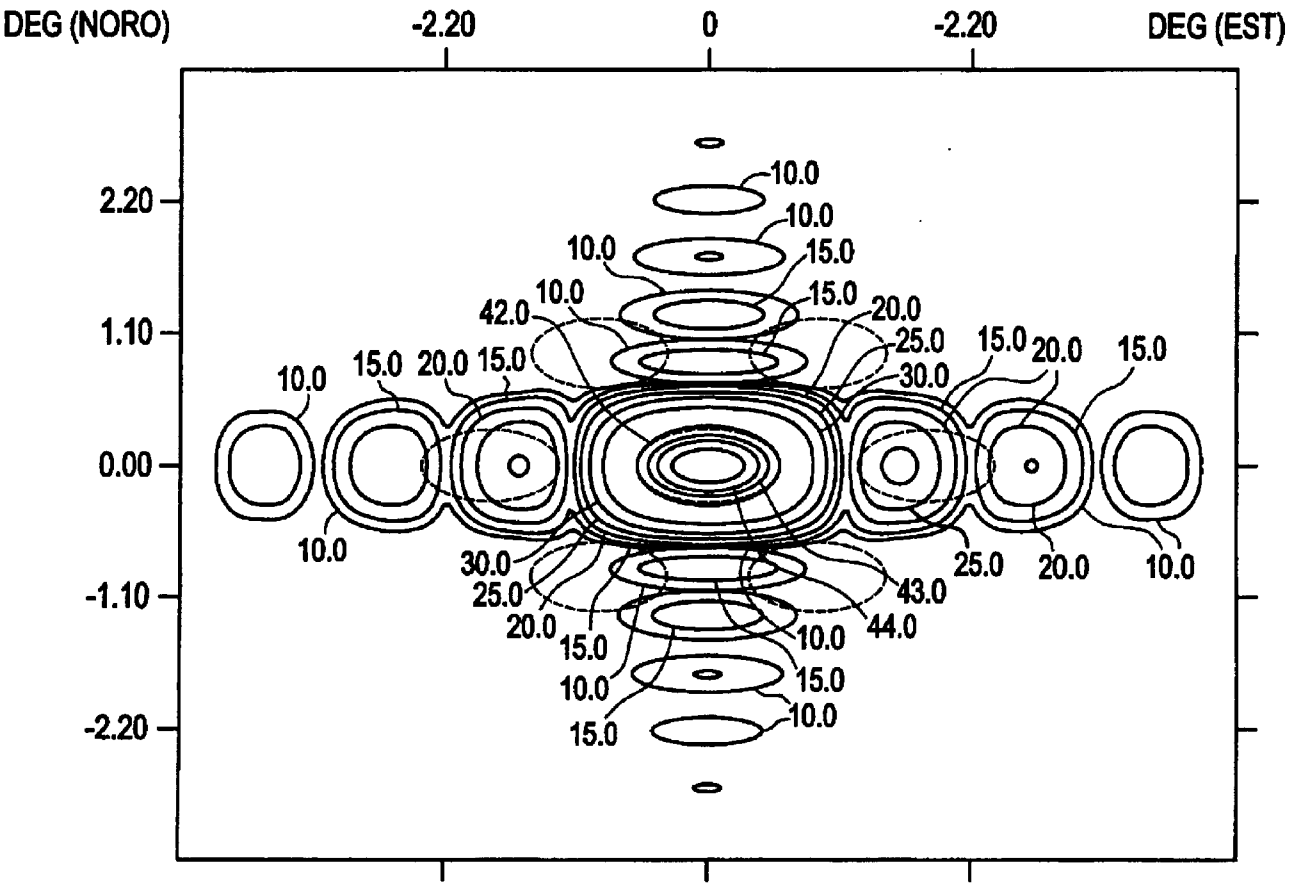
FIG. 5 shows the spot beams formed on the ground from a set of four rectangular parabolic antennas, each antenna being illuminated by a set of feeds radiating with the same frequency and same polarization.

Referring now to FIG. 5, the beam resulting from a feed 13 will have an elliptical cross-section and its side lobes are mainly on the axis related to greater parabolic arc. This means that each spot 23 is anisotropic.

Figure 6:
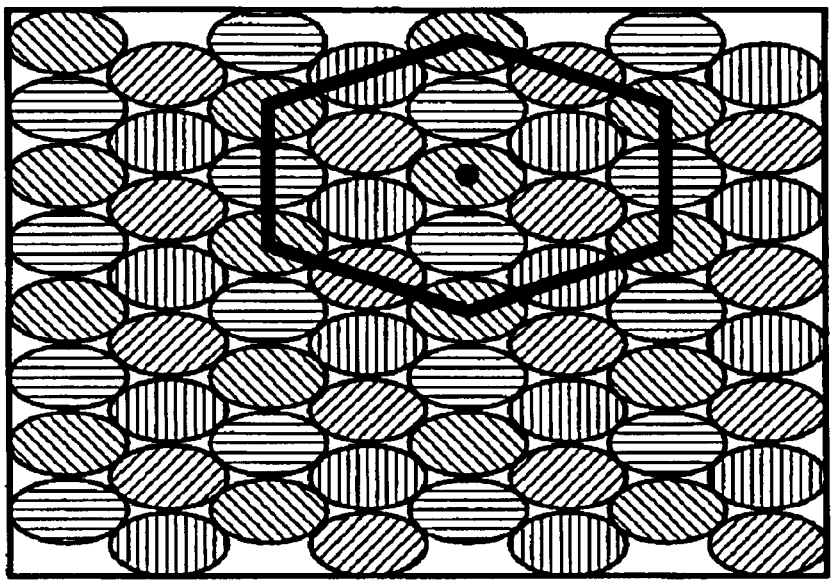
FIG. 6 shows so-called four color schemes where one color symbolizes a frequency and a polarization system in accordance with the present invention.
Figure 6:
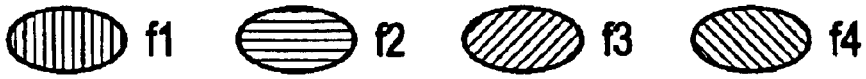
Figure 6:
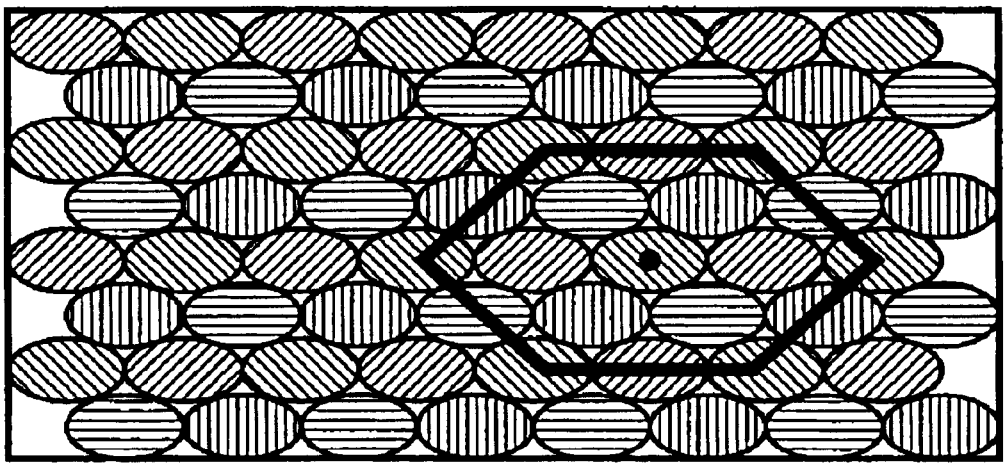

In addition, the antenna system has one parabolic surface 12 and can be used with different feeds 13–16 which can be clustered by frequency f1, f2, f3 and f4, see FIG. 6. Depending on the position of the each feed 13–16 the beams of the same frequency f1 can be directed in specific directions to illuminate closed areas on the Earth, shown in FIG. 6. So, the spots 23 of the same frequency f1 are arranged at parallelepiped pattern, for example, hexagonal shape.

Thus, the side lobes of a first spot 23 corresponding to one frequency f1 are out of a second spot 23 of the same frequency f1. The second spot 23 is closed to the first spot 23.

The isolation is improved, up to 20 dB, among spots 23 of the same frequency f1. As a result, the signal to noise ratio of the offset signal is decreased and there is no need to provide means to the antenna system to increase the isolation among the beams of the same frequency f1.

In the most general case, and as shown in FIG. 3, these parabolic arcs (AA', BB') are not the same and the cross-section of the beam can have a different length to width ratio dictated by the shape of the reflector 12. Therefore, the parabolic reflector 12 is adapted to form an elongated spot 23 on the ground.

Therefore an improvement layout of the spots 23 is provided, as shown in FIG. 6. This layout of spots 23 allows reducing the interference produced by another spots 23 on a given spot 23 of the same frequency f1. Since side lobes of each beam radiate out of the spots 23 provide by other feeds 13–16 of the same frequency f1, namely it prevents interference among spots 23 of the same frequency f1.

Two layouts of elliptical spots 23 can be provided, firstly one layout is obtained by aligning of the spots 23 over the short axis of the elliptical shape. The other one by aligning of the spots over the long axis of the elliptical shape. Other layouts can be designed by rotating the axis of the spots.

Therefore, the disposition and orientation of the reflector 12 and the feeds 13–16 determine the preferred direction and the shape of the beam of radiation.

As the plurality of the feeds 13–16 are arranged according hexagonal pattern or parallelogram pattern. This means that the feeds 13–16 of the same frequency f1 form a hexagon. Accordingly, other feeds of different frequency f2, f3 and f4 on another antenna are interleaved as so the spots 23 are also interleaved.

What is claimed is:

1. A multi-beam antenna system comprising a parabolic reflector with a parallelogram perimeter, which is illuminated by a plurality of feed elements that are adapted to cluster by frequency, wherein the multi-beam antenna is adapted to create a first beam corresponding to a first frequency to illuminate a first spot, a second beam corresponding to the first frequency to illuminate a second spot, such that the first and second spots are ellipses and un-adjacent, and wherein spots corresponding to beams of other frequencies are adapted to interleave in a hexagonal pattern.

2. The multi-beam antenna system according to claim 1, wherein the first and second spots corresponding to beams of the first frequency are adapted to arrange in at parallelepiped pattern.

3. The multi-beam antenna system according to claim 1, wherein the first and second spots corresponding to beams of the first frequency are adapted to arrange in a hexagonal pattern.

4. An aeronautical vehicle for communication, wherein, the aeronautic vehicle is adapted to have an onboard multi-beam antenna system according to claim 1.

5. The multi-beam antenna system according to claim 1, wherein the first and second spots are aligned with respect to the short axis of the elliptical shape of the first and second spots.

6. The multi-beam antenna system according to claim 1, wherein the first and second spots are aligned with respect to the long axis of the elliptical shape of the first and second spots.

7. A multi-beam antenna system comprising a parabolic reflector with a parallelogram perimeter, which is illuminated by a plurality of feed elements, wherein the multi-beam antenna is adapted to create a first beam corresponding to a first frequency to illuminate a first spot, a second beam corresponding to the first frequency to illuminate a second spot, such that the first and second spots have elliptical shapes and un-adjacent, and wherein the first and second spots are aligned with respect to the short axis of the elliptical shape of the first and second spots.

8. A multi-beam antenna system comprising a parabolic reflector with a parallelogram perimeter, which is illuminated by a plurality of feed elements, wherein the multi-beam antenna is adapted to create a first beam corresponding to a first frequency to illuminate a first spot, a second beam corresponding to the first frequency to illuminate a second spot, such that the first and second spots have elliptical shapes and un-adjacent, and wherein the first and second spots are aligned with respect to the long axis of the elliptical shape of the first and second spots.

* * * * *